US008468645B2

(12) United States Patent
Kim et al.

(10) Patent No.: US 8,468,645 B2
(45) Date of Patent: Jun. 25, 2013

(54) CLEANING ROBOT HAVING EXHAUST AIR FEEDBACK FUNCTION

(75) Inventors: Byung-Soo Kim, Daejeon (KR); Jae-Young Choi, Daejeon (KR); Se-Won Lee, Daejeon (KR); Sang-Hee Kim, Daejeon (KR)

(73) Assignee: Hanool Robotics Corp., Gyeonggi-do (KR)

( * ) Notice: Subject to any disclaimer, the term of this patent is extended or adjusted under 35 U.S.C. 154(b) by 953 days.

(21) Appl. No.: 12/527,360

(22) PCT Filed: Aug. 30, 2007

(86) PCT No.: PCT/KR2007/004175

§ 371 (c)(1),
(2), (4) Date: Aug. 14, 2009

(87) PCT Pub. No.: WO2008/099999

PCT Pub. Date: Aug. 21, 2008

(65) Prior Publication Data

US 2010/0088840 A1 Apr. 15, 2010

(30) Foreign Application Priority Data

Feb. 15, 2007 (KR) ..... 10-2007-0015775
Aug. 17, 2007 (KR) ..... 10-2007-0082620

(51) Int. Cl.
*A47L 9/28* (2006.01)

(52) U.S. Cl.
USPC ..... 15/319; 15/339; 15/340.3

(58) Field of Classification Search
USPC ..... 15/319, 339, 340.1, 340.3
IPC ..... A47L 9/28
See application file for complete search history.

(56) References Cited

U.S. PATENT DOCUMENTS 5,457,848 A * 10/1995 Miwa ..... 15/346
7,059,012 B2 * 6/2006 Song et al. ..... 15/340.3

FOREIGN PATENT DOCUMENTS

| | | | |
|---|---|---|---|
| JP | 07-044911 | B2 | 5/1995 |
| JP | 08-089448 | A | 4/1996 |
| JP | 2003-310489 | A | 11/2003 |
| JP | 2004-160102 | A | 6/2004 |
| KR | 10-2007-0005430 | A | 1/2007 |

* cited by examiner

*Primary Examiner* — David Redding
(74) *Attorney, Agent, or Firm* — Rabin & Berdo, P.C.

(57) ABSTRACT

A cleaning robot having an exhaust air feedback function can utilize the vacuum suction force generated by a suction motor as well as spray exhaust air onto the surface to be cleaned by circulating the air using the suction motor, thereby improving foreign material removal efficiency. The cleaning robot includes a suction unit, a suction motor for drawing in foreign materials from the surface to be cleaned, along with air, through the suction unit, a dust collector for capturing the foreign materials, so that the air is exhausted through the suction motor, and an exhaust air feedback unit for feeding the air. The cleaning robot also includes a spray nozzle unit inserted into the suction unit and placed on the leading end of the suction unit, the spray nozzle unit spraying the air fed by the exhaust air feedback unit, to the surface to be cleaned.

12 Claims, 17 Drawing Sheets

CLEANING ROBOT HAVING EXHAUST AIR FEEDBACK FUNCTION

CROSS-REFERENCE TO RELATED APPLICATION

This application is a National Stage entry of International Application No. PCT/KR2007/004175, filed Aug. 30, 2007, which claims priority to Korean Patent Application No. 10-2007-0015775, filed Feb. 15, 2007 and Korean Patent Application No. 10-2007-0082620, filed Aug. 17, 2007. The disclosures of the prior applications are hereby incorporated in their entirety by reference.

TECHNICAL FIELD

The present invention relates to a cleaning robot having an exhaust air feedback function, and more particularly, to a cleaning robot having an exhaust air feedback function, which sprays the circulating air to a surface to be cleaned through a suction hole that draws in foreign materials by exhausting the air using a suction motor and an impeller inside the cleaning robot.

BACKGROUND ART

In general, a cleaning robot automatically cleans an area to be cleaned by autonomously drawing in foreign materials such as dust from the floor while running on the area to be cleaned without requiring the user to operate it. When its battery power is about to be exhausted, the cleaning robot automatically returns to its charging position. After being recharged, the cleaning robot returns to the area that was being cleaned and resumes the cleaning operation.

The cleaning robot is designed to autonomously clean foreign materials from the surface to be cleaned while running on the area to be cleaned. However, in the case where the foreign materials are stuck to the surface to be cleaned or to a carpet, the cleaning robot sometimes moves along the running pattern in the area to be cleaned without completely cleaning the foreign materials.

In consideration of places of use and mobility, the cleaning robot is limited in the size and the weight thereof. That is, the cleaning robot is required to have a small size and a light weight, and a suction motor having a large capacity cannot be installed therein. Since the suction force is limited, the cleaning robot sometimes fails to completely remove the foreign materials.

DISCLOSURE

Technical Problem

Such a problem is more severe in the case of a vacuum suction type cleaning robot, to the extent that the cleaning robot not only fails to remove the foreign materials by drawing them in but also drags the foreign materials, thereby enlarging the area that must be cleaned.

Of course, in order to overcome the problem related to the suction force of a small motor, a suction brush system having a vacuum suction unit and a brush is used. The suction brush system raises the foreign materials into the cleaning robot using the brush and draws in the raised foreign material using the vacuum suction unit. While this system can remove the foreign materials from a surface portion to be cleaned that is touched by the brush, the foreign materials on other areas of the surface portion to be cleaned that are not touched by the brush must be drawn in only by suction force. Thus, the foreign materials are not sufficiently removed from the surface areas that are not touched by the brush. In particular, a suction hole, which is placed above the brush, reduces the suction force, and thus foreign materials remain on the surface when they are not removed by the brush.

As described above, while the suction brush system was made to overcome the drawbacks of the vacuum suction system, it fails to completely remove foreign materials. In addition, when the brush is added, an additional device should be further provided. However, this raises the cost of the product and makes the maintenance thereof difficult.

Furthermore, in the conventional cleaning robot, dust is drawn in along with the air through the suction hole, and is captured by a dust collector. When the dust is removed, the air is exhausted through a vent to the outside, and this flow of exhaust air scatters foreign materials deposited near the cleaning robot around the interior of the room.

The present invention has been made to solve the foregoing problems with the prior art, and therefore an object of the present invention is to provide a cleaning robot having an exhaust air feedback function, which can utilize the vacuum suction force generated by a suction motor as well as spray exhaust air onto the surface to be cleaned by circulating the air using the suction motor, thereby improving foreign material removal efficiency.

Another object of the present invention is to provide a cleaning robot having an exhaust air feedback function, which can remove foreign materials both using vacuum suction and by spraying circulated air, thereby reducing the size of a suction motor and thus reducing the size and the weight of the cleaning robot.

A further object of the present invention is to provide a cleaning robot having an exhaust air feedback function, which can uniformly spray exhaust air onto the surface to be cleaned in order to uniformly scatter foreign materials from the surface.

A further another object of the present invention is to provide a cleaning robot having an exhaust air feedback function, which can regulate the quantity of the air to be sprayed, thereby enabling efficient cleaning of objects to be cleaned.

Another object of the present invention is to provide a cleaning robot having an exhaust air feedback function, which can scatter foreign materials from the surface to be cleaned using exhaust air while preventing the foreign materials from being dispersed, thereby effectively removing the foreign materials.

A further object of the present invention is to provide a cleaning robot having an exhaust air feedback function, which can prevent the exhaust air circulating through the suction motor from being directly exhausted to the outside, thereby preventing indoor air from being polluted as well as realizing an effect exceeding that obtained through the use of a brush, without using the brush.

Further another object of the present invention is to provide a cleaning robot having an exhaust air feedback function, which can improve the circulating path of the air that is drawn in, thereby enhancing the efficiency of the circulating path of the exhaust air.

Yet another object of the present invention is to provide a cleaning robot having an exhaust air feedback function, which has a spray nozzle unit and side nozzle units in order to spray circulating air to the center from the front, rear, left and right, so that foreign materials can be easily scattered from the surface to be cleaned and can be easily moved to the suction hole, thereby enhancing cleaning efficiency as well as realizing a better cleaning effect using a given amount of power.

Technical Solution

The present invention provides a cleaning robot, which includes a suction unit disposed in a lower portion thereof, a suction motor for drawing in foreign materials from the surface to be cleaned, along with air, through the suction unit, a dust collector for capturing the foreign materials that are drawn in, so that the air from which the foreign materials have been removed is exhausted through the suction motor, and an exhaust air feedback unit for feeding the air, which has been exhausted through the suction motor. The cleaning robot also includes a spray nozzle unit inserted into the suction unit and placed on the leading end of the suction unit, the spray nozzle unit spraying the air fed by the exhaust air feedback unit, to the surface to be cleaned.

As set forth above, the cleaning robot of the invention can spray (or feed back) the circulating air, exhausted through the suction motor, to the suction unit in the lower part of the cleaning robot in order to draw in and remove the foreign materials using both the spraying force of the circulating air and the suction force of the suction motor, thereby achieving excellent removing force.

Since the invention can draw in and remove the foreign materials using both the spraying force of the circulating air and the suction force of the suction motor, the invention can adopt a suction motor having a small size and a small capacity, and thus can have the advantages of a small size and a light weight.

In addition, the nozzle can uniformly spray the circulating air at a position adjacent to the leading end of the suction hole, thereby easily scattering the foreign materials from the surface to be cleaned, to which the foreign materials have been adhered.

In addition, when the nozzle sprays the circulating air at the position adjacent to the leading end of the suction hole, the circulating air forms an air curtain, which cooperates with an anti-dispersion belt in the suction unit, placed behind the suction hole, in order to prevent the foreign materials from escaping from the cleaning robot and dispersing.

Furthermore, since the spray nozzle unit is inserted into the suction unit to be movable as a unitary body, it is possible to vertically move the spray nozzle unit according to the condition of the surface to be cleaned as well as improve the cleaning efficiency of the surface to be cleaned.

Furthermore, a spray regulator, which is disposed in the spray nozzle unit, can regulate the quantity of the circulating air to be sprayed according to the condition of the surface to be cleaned, thereby improving the cleaning efficiency.

Furthermore, a suction motor support is provided to guide the circulating air, which has passed through the suction motor, so that it is exhausted in two directions, thereby improving the transporting power of the circulating air and thus enhancing the spraying power of the spray nozzle unit.

Moreover, side nozzle units cooperate with the spray nozzle unit to cause the circulating air to flow to the center, thereby efficiently removing foreign materials that have been scattered from the surface to be cleaned.

<Major Reference Numerals of the Drawings>

| | |
|---|---|
| 100: exhaust air feedback unit | 110: left air passage |
| 120: right air passage | 130: rotatable grill |
| 131: suction motor support | 132: outlet |
| 140: support | 150: connecting passage |
| 151: air inlet passage | 200: spray nozzle unit |
| 210: housing | 211: rear surface |
| 212: front surface | 213: guide |
| 220: connecting section | 230: air guide |
| 240: air spray passage | 250: partition |
| 260: buffer area | 270: exhaust hole |
| 280: spray regulator | 218: openable hole |
| 282: left spray regulating plate | |
| 283: right spray regulating plate | |
| 284: slope | 285: left operation button |
| 286: right operation button | 287: operation spring |
| 285': left movable button | 286': right movable button |
| 300: suction unit | 310: suction unit body |
| 320: insert recess | 330: suction hole |
| 340: anti-dispersion belt | 350: auxiliary roller |
| 400: circulating air | 410: external air |
| 500: cleaning robot | 510: body |
| 520: dust collector | 600: surface to be cleaned |
| 700: side nozzle unit | 710: side nozzle |
| 711: coupling section | 712: nozzle hole |
| 713: lower portion | 720: auxiliary air passage |

BEST MODE

The present invention provides a cleaning robot, which includes a suction unit disposed in a lower portion thereof, a suction motor for drawing in foreign materials from a surface to be cleaned, along with air, through the suction unit, a dust collector for capturing the foreign materials that are drawn in, so that the air from which the foreign materials have been removed is exhausted through the suction motor, and an exhaust air feedback unit for feeding the air, which is exhausted through the suction motor. The cleaning robot also includes a spray nozzle unit inserted into the suction unit and placed on a leading end of the suction unit, the spray nozzle unit spraying the air that is fed by the exhaust air feedback unit onto the surface to be cleaned.

Hereinafter, the present invention will be described more fully with reference to the accompanying drawings.

Figure 1:
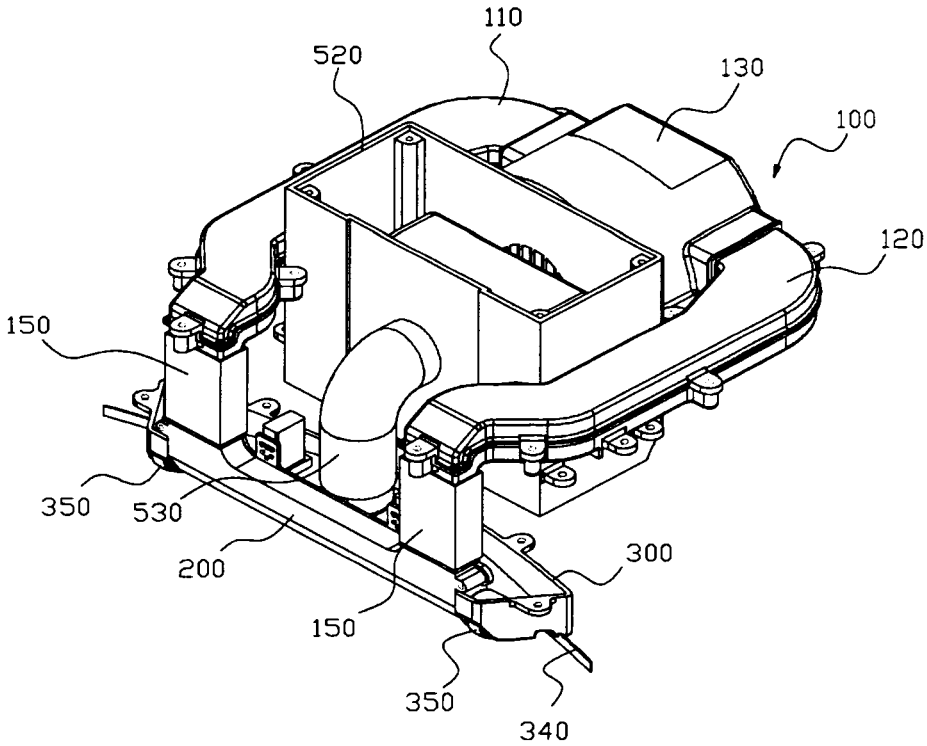
FIG. 1 is a perspective view illustrating the overall construction of an exhaust air feedback system according to the present invention.
Figure 2:
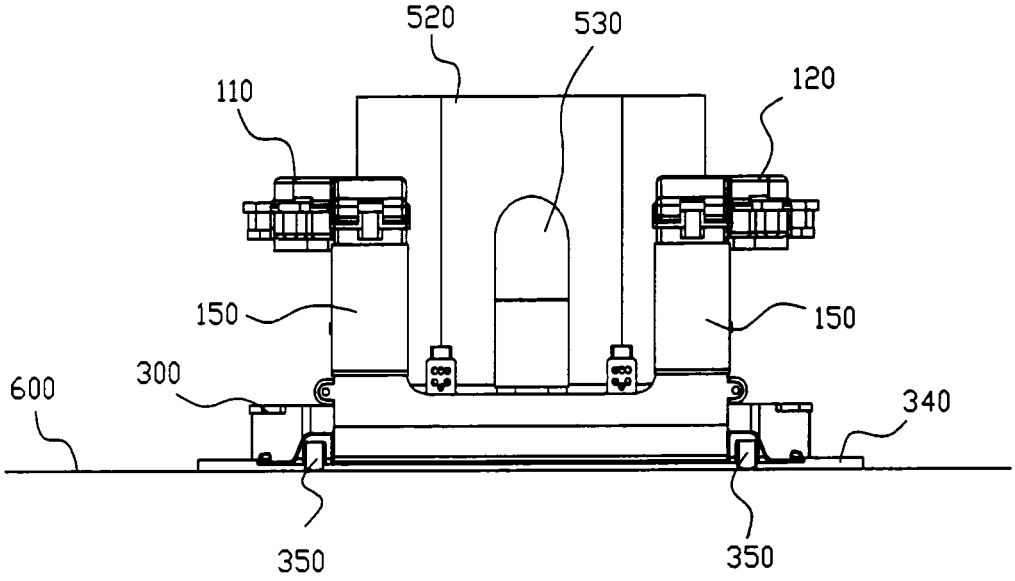
FIG. 2 is a front elevation view illustrating the exhaust air feedback system according to the present invention.
Figure 3:
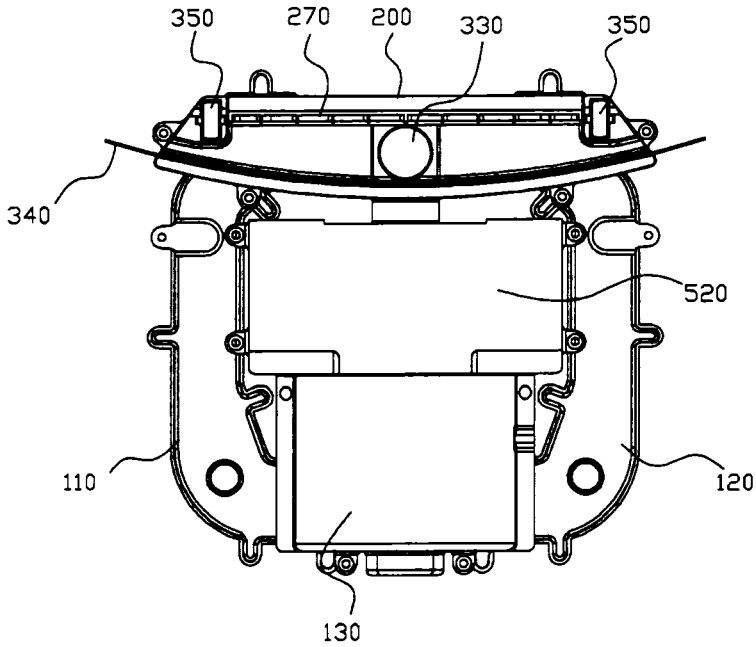
FIG. 3 is a bottom view illustrating the exhaust air feedback system according to the present invention.
Figure 4:
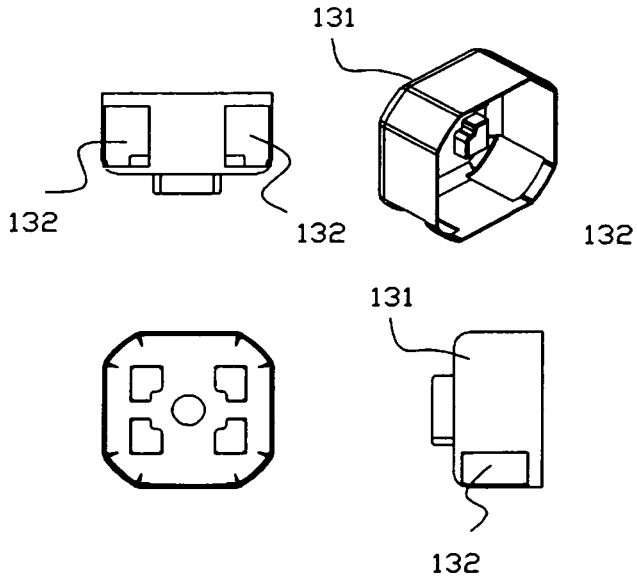
FIG. 4 illustrates the construction of a suction motor support according to the present invention.
Figure 5:
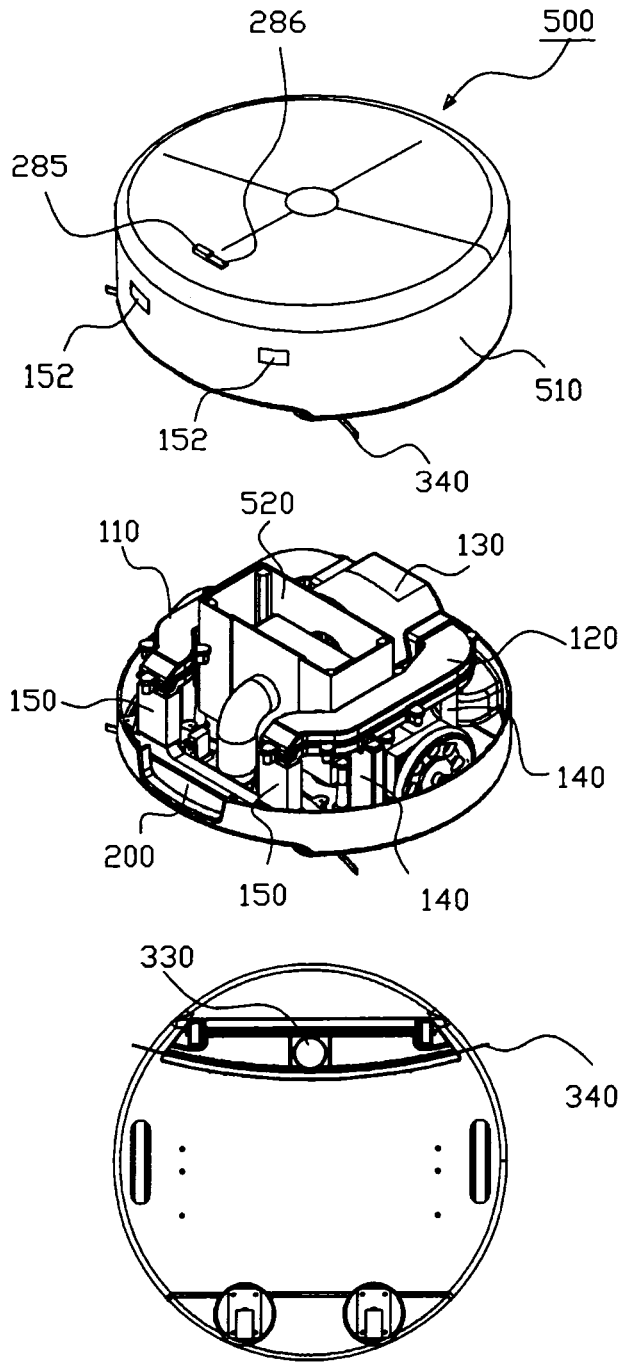
FIG. 5 illustrates the construction of a cleaning robot according to the present invention.
Figure 6:
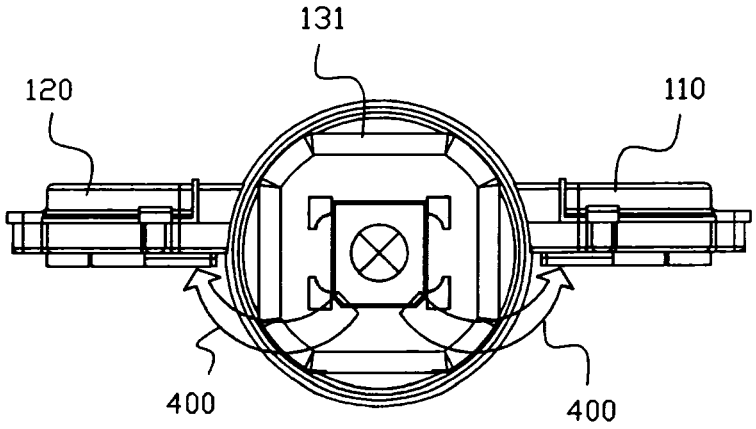
FIG. 6 illustrates the flow of the circulating air according to the present invention.
Figure 7:
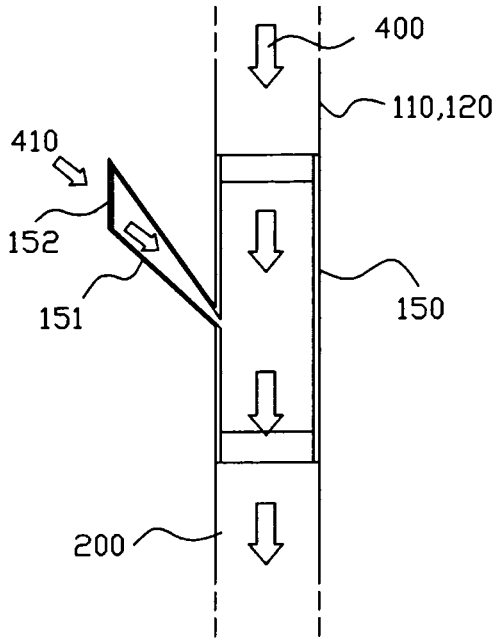
FIG. 7 illustrates a change in the flow of the circulating air according to the present invention.
Figure 7:
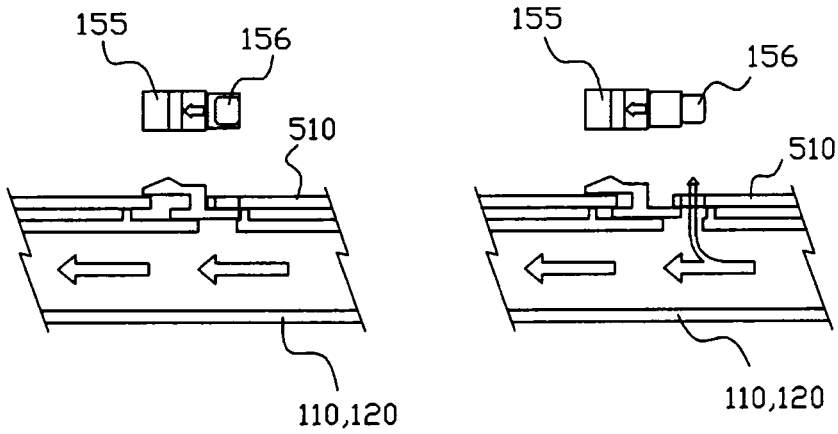
Figure 8:
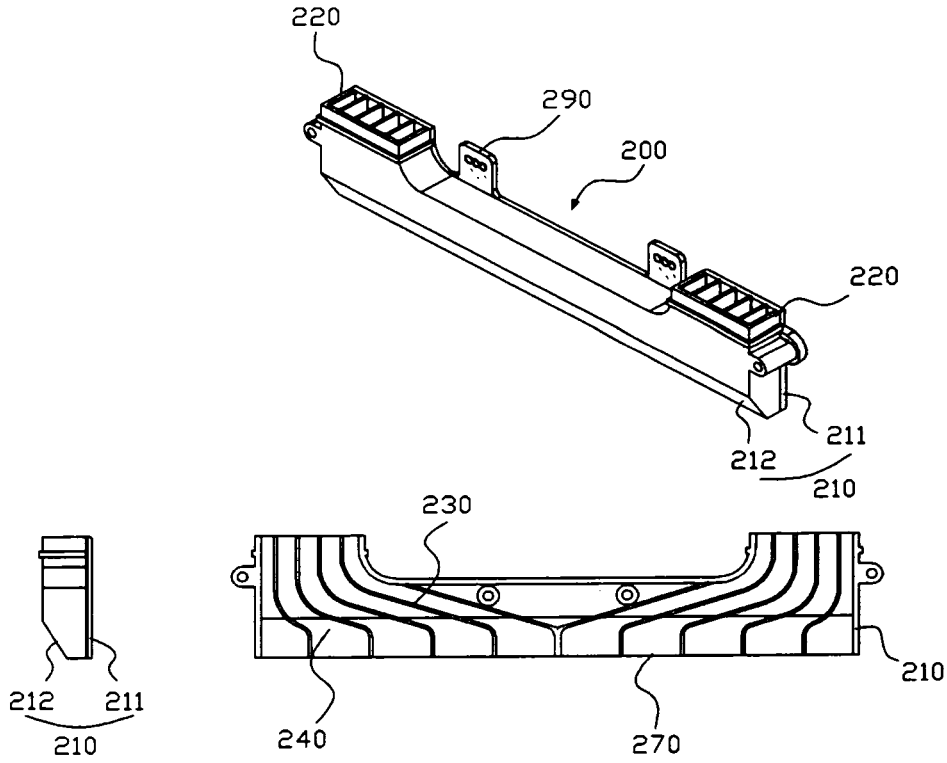
FIG. 8 illustrates the construction of the spray nozzle unit according to the present invention.
Figure 9:
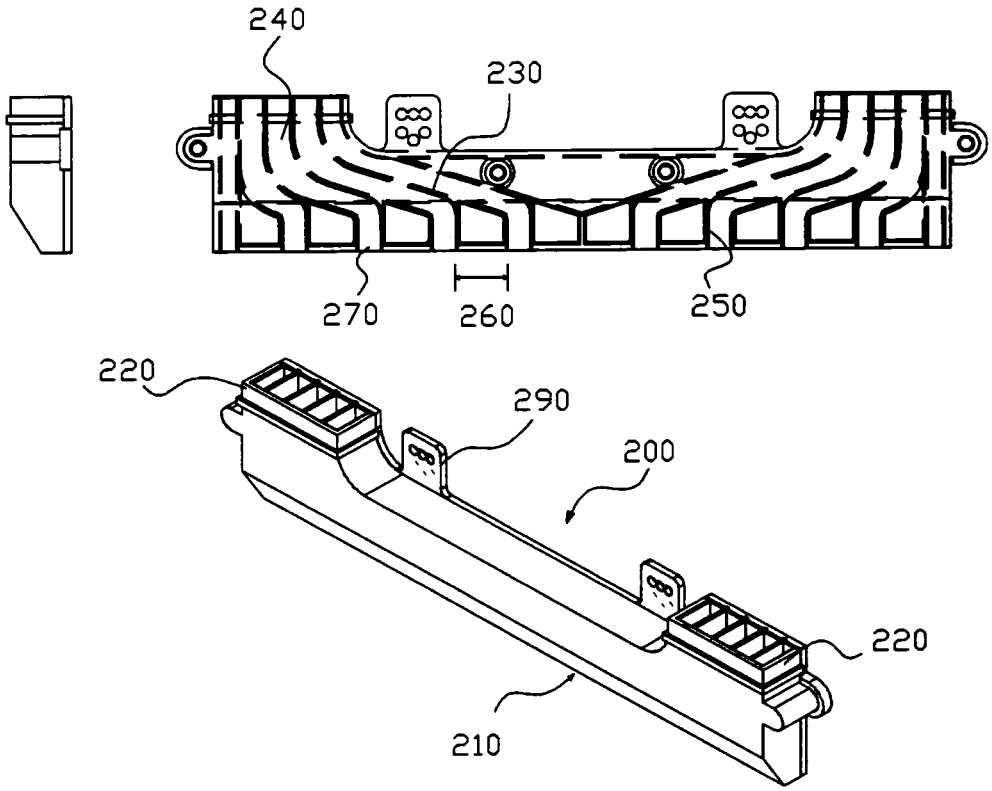
FIG. 9 illustrates the construction of an alternative to the spray nozzle unit according to the present invention.
Figure 10:
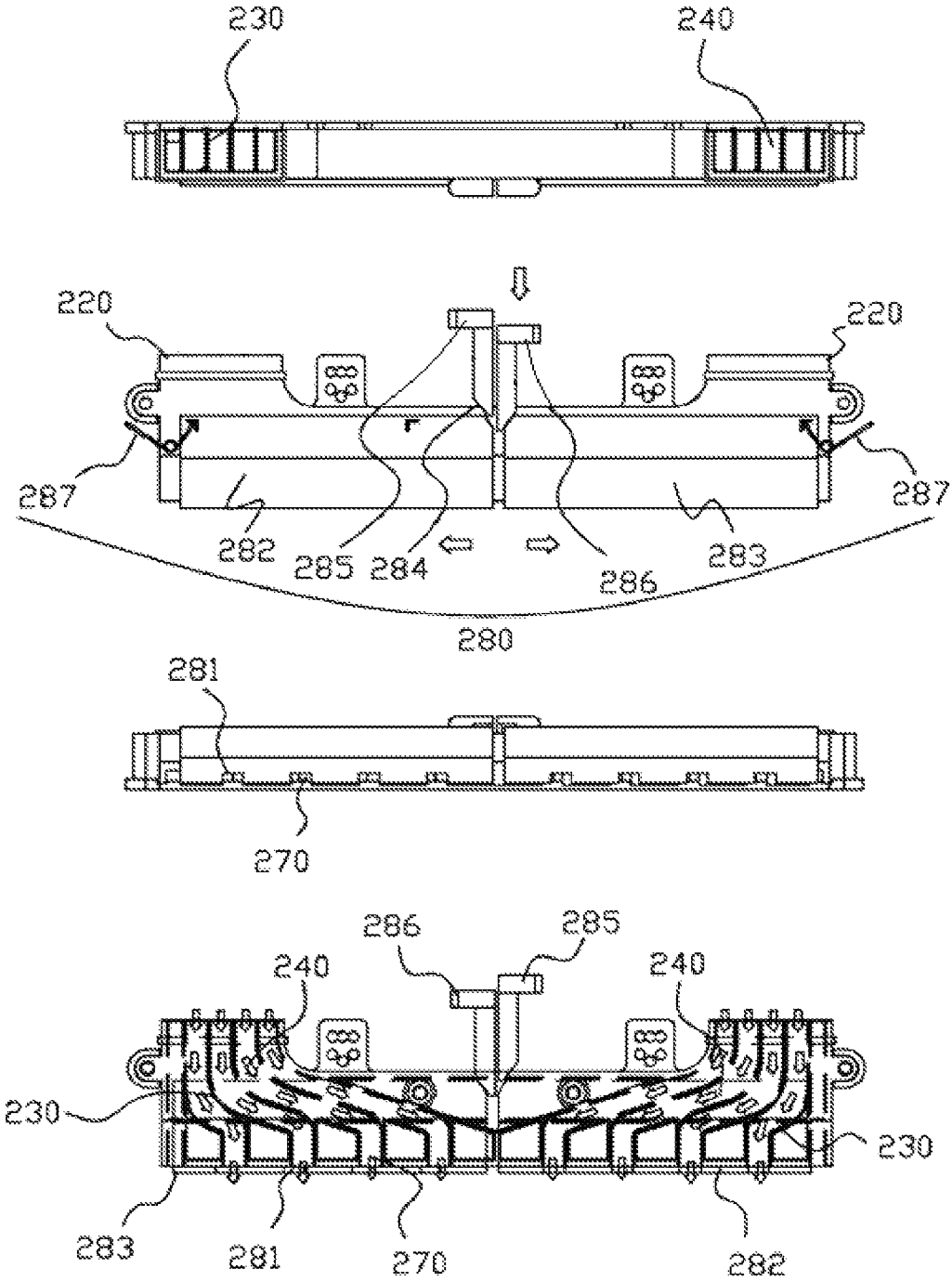
FIG. 10 illustrates the construction of a spray regulator according to the present invention.
Figure 11:
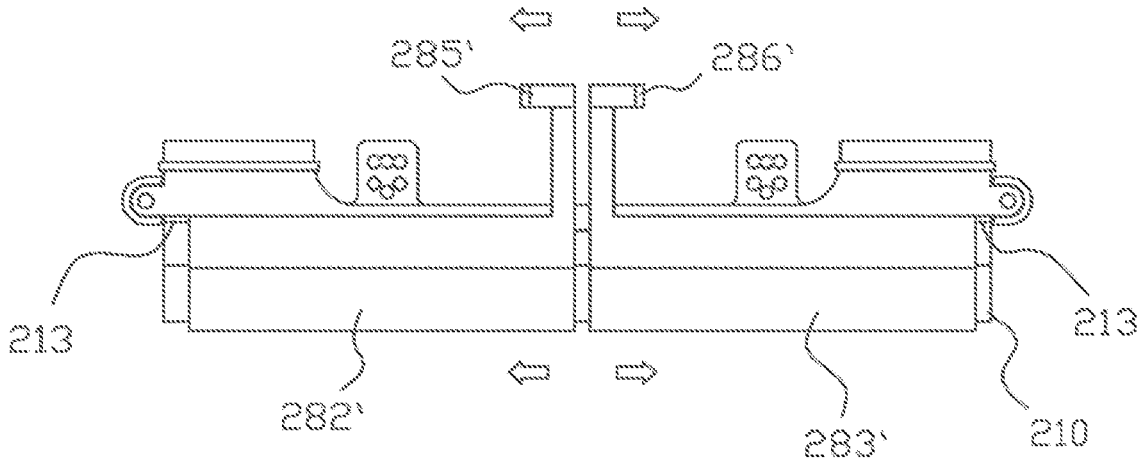
FIG. 11 illustrates the construction of an alternative to the spray regulator according to the present invention.
Figure 12:
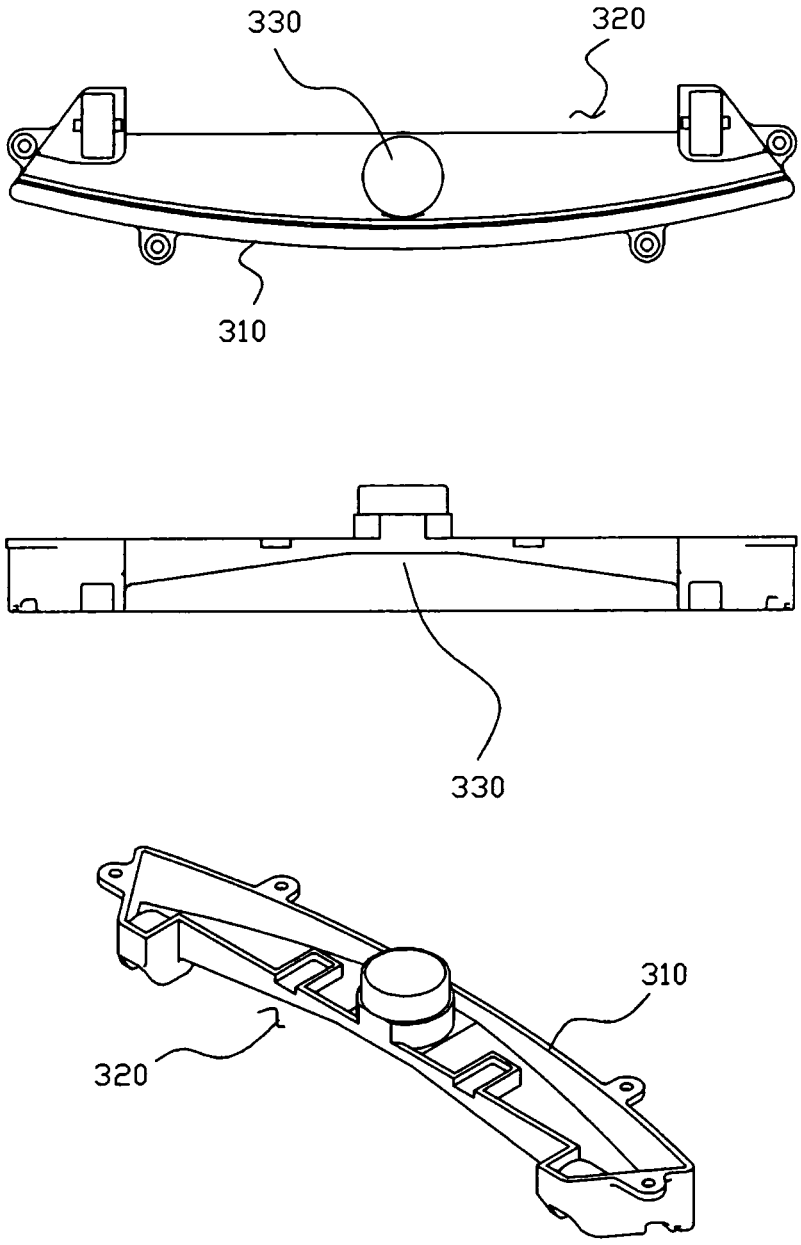
FIG. 12 illustrates the construction of the suction unit according to the present invention.

FIG. 1 is a perspective view illustrating the overall construction of an exhaust air feedback system according to the present invention, FIG. 2 is a front elevation view illustrating the exhaust air feedback system according to the present invention, FIG. 3 is a bottom view illustrating the exhaust air feedback system according to the present invention, FIG. 4 illustrates the construction of a suction motor support according to the present invention, FIG. 5 illustrates the construction of a cleaning robot according to the present invention, FIG. 6 illustrates the flow of the circulating air according to the present invention, FIG. 7 illustrates a change in the flow of the circulating air according to the present invention, FIG. 8 illustrates the construction of the spray nozzle unit according to the present invention, FIG. 9 illustrates the construction of an alternative to the spray nozzle unit according to the present invention, FIG. 10 illustrates the construction of a spray regulator according to the present invention, FIG. 11 illustrates the construction of an alternative to the spray regulator according to the present invention, and FIG. 12 illustrates the construction of the suction unit according to the present invention. The cleaning robot of the present invention includes a suction unit disposed in a lower portion thereof, a suction motor for drawing in foreign materials from a surface to be cleaned, along with air, through the suction unit, and a dust collector for capturing the foreign materials that are drawn in, so that the air from which the foreign materials have been removed is exhausted through the suction motor. The cleaning robot also includes an exhaust air feedback unit 100 for feeding the air, which is exhausted through the suction motor. The exhaust air feedback unit 100 encloses the suction motor therein and has left and right air passages 110 and 120 on the right and the left of the suction motor. The cleaning robot also includes a spray nozzle unit 200 having opposing ends, which are connected to the left and right air passages 110 and 120 of the exhaust air feedback unit 100. The spray nozzle unit 200 is placed on the leading end of the suction unit 300.

As shown in FIGS. 1 to 3, the exhaust air feedback unit 100 includes a rotatable grill 130, which is connected to a dust collector 520, is placed inside the cleaning robot 500, and has the suction motor enclosed therein. Each of the left and right air passages 110 and 120 has one end portion, which is connected to the opposite end portions of the rotatable grill 130 to communicate therewith, and the opposite end portion, which is connected to the spray nozzle unit 200.

The rotatable grill 130 supports the suction motor, and introduces the exhaust air, that is, the air circulating through the suction motor, to the right and left air passages. As shown in FIG. 4, outlets 132 are formed in both sides of the lower portion of the suction motor support 131 to exhaust the circulating air through the suction motor.

As shown in FIGS. 1, 3 and 5, the left and right air passages 110 and 120 are fixedly supported on the body 510 of the cleaning robot 500 by a plurality of supports 140. The left and right air passages 110 and 120 are placed on both sides of the dust collector 520, and are connected to the spray nozzle unit 200.

As shown in FIG. 6, the exhaust air feedback unit 100 allows the exhaust air, that is, the air circulating through the suction motor, to be exhausted through the outlets 132 of the suction motor support 131 to both sides of the suction motor. After it is exhausted, the circulating air 400 is blown into the left and right air passages 110 and 120 through the rotatable grill. Here, since the circulating air 400 flowing through the suction motor is given rotational force by the actuation of the suction motor, it is exhausted through the outlets 132 on both sides of the suction motor support 131 while maintaining the rotational force, and is rapidly blown into the left and right air passages 110 and 120.

As shown in FIGS. 1 to 3, the exhaust air feedback unit 100 also has connecting passages 150, each of which is placed between either one of the left and the right air passages 110 and 120 and the spray nozzle unit 200, thereby connecting the distal end of the left and right air passages 110 and 120 to the spray nozzle unit 200. Since the connecting passages 150 are further provided, the spray nozzle 200 and the left and right air passages 110 and 120 can be assembled and disassembled more easily.

As shown in FIGS. 5 and 7, each of the connecting passages 150 also has an air inlet passage 151, which leads to the outside of the cleaning robot 500. The air inlet passage 151 has a larger cross section at one end portion, which leads to the outside of the cleaning robot 500, and a smaller cross section at the opposite end portion, which is connected to the connecting passage 150.

The air inlet passage 151 introduces the external air 410 and mixes it with the circulating air 400, thereby dropping the temperature of the circulating air 400. That is, when the circulating air 400 is fed toward the spray nozzle 200 through the left and right air passages 110 and 120, the rapid flow of the circulating air 400 causes the external air 410 to be drawn in through the air inlet passages 151 into the connecting passages 150, where the external air 410 mixes with the circulating air 400.

A filter 152, which serves to remove foreign materials, is disposed in one end portion of the air inlet passage 151, which is connected to the cleaning robot body 510.

As shown in FIG. 7, a vent hole 156 is formed in a respective one of the left and right air passages 110 and 120, and an openable knob 155, which serves to open or close the vent hole 156, is disposed to be controllable from outside the robot body 510. This makes it possible to exhaust part of the air circulating through the left and right air passages 110 and 120 in order to regulate the flow or intensity of the circulating air.

When a large amount of the circulating air collides with the surface to be cleaned, a problem such as the backflow of fine dust may take place. The openable knob solves this problem by blowing part of the air flow, which passes through the left and right air passages, into the air.

The spray nozzle unit 200 serves to uniformly spray the circulating air 400, which is fed through the exhaust air feedback unit, to the surface to be cleaned. The spray nozzle unit 200 is inserted into the suction unit 300, so that each of opposing end portions of the upper part thereof is connected to the distal end of either one of the left and right air passages 110 and 120 or to either one of the connecting passages 150, which are connected to the distal ends of the left and right air passages 110 and 120. The spray nozzle unit 200 is placed at the leading end of the suction unit 300.

As shown in FIGS. 8 and 9, the spray nozzle unit 200 includes a housing 210 having a slope on the lower surface portion, connecting sections 220, each of which is arranged on either side of the upper part of the housing 210 to communicate with the distal end of a respective one of the left and right air passages 110 and 120 or with a respective one of the connecting passages 150, a plurality of air guides 230 dividing the interior of the housing 210 into a plurality of spaces, which lead from the connecting sections 220 in the upper part of the housing 210 to the interior of the housing having the sloped face, and a plurality of air spray passages 240 defined by the air guides.

The spray nozzle is connected to the suction unit by a bracket 290, which is integrated with the housing.

The housing 210 is connected to the suction unit 300 by the brackets, in which the rear face 211 is perpendicular to the moving direction of the cleaning robot, and the bottom of the front face 211 is sloped rearward.

The air guides 230 are arranged inside the housing 210, dividing the interior of the housing 210 into a plurality of spaces, which define the air spray passages 240. The air spray passages 240 carry and spray the air, which is fed from the exhaust air feedback unit 100, to the surface to be cleaned.

That is, the air guides 230 are arranged inside the housing 210 so that the top portions thereof are positioned on the connecting sections 220, which are formed on the top portion of the housing, and the bottom portions thereof are positioned on the bottom of the housing, thereby defining the air spray passages 240.

The air spray passages 240, defined by the air guides 230, act to introduce the circulating air 400 from the exhaust air feedback unit 100 so that it is uniformly sprayed on the surface to be cleaned. The lower end (hereinafter referred to as "exit hole") of a respective one of the air spray passages 240 functions as a spray nozzle that directly sprays the air onto the surface to be cleaned.

Inside the housing, as shown in FIG. 9, partitions 250 which block the passage of the circulating air are also disposed on the lower ends of the air guides 230 in order to reduce the lower cross section of the air spray passages 240, which spray the circulating air onto the surface to be cleaned. The partitions 250 also define buffer areas 260, each of which is arranged between one air spray passage and the next one, in order to improve the flow of the air and the spray rate.

Since the lower cross section of the air spray passages, which directly spray the air onto the surface to be cleaned, is larger than the upper cross section of the air spray passages connected to the exhaust air feedback unit, when the interval between adjacent air spray passages is exclusively dependent on the thickness of the air guides, the flow rate of the air can drop, and the air sprayed through one of the air spray passages to the surface to be cleaned can collide with the air sprayed through an adjacent air spray passage, thereby adversely affecting the flow of the air. Accordingly, the partitions are further disposed on the air guides to define the buffer areas, which alternate with the air spray passages, thereby further smoothing the air flow.

Due to the lower portion configuration of the housing 210 and the air spray passages 240 defined by the air guides 230, the air spray nozzle unit 200 of the present invention uniformly sprays the circulating air 400, which is fed from the exhaust air feedback unit 100, onto the surface to be cleaned while preventing the air from exiting.

In addition, air blocking partitions can be disposed on the spray nozzle unit, that is, the lower ends of the air guides shown in FIG. 9, so that a spray regulator 280 can be provided in the spray nozzle unit, which has the buffer areas alternating with the air spray passages. The spray regulator 280 can regulate the amount of circulating air that is sprayed by adjusting the size of the exit holes 270, that is, the lower ends of the air spray passages.

As shown in FIG. 10, the spray regulator 280 includes left and right spray regulating plates 282 and 283, which are disposed outside the housing 210 of the spray nozzle unit and are laterally slidable. The spray regulating plates 282 and 283 have openable holes 281 in the bottom surface, which are the same size as the exit holes 270. The spray regulator 280 also includes one-touch type left and right operation buttons 285 and 286, each of which has a distal slope 284 in contact with either one of the left and right spray regulating plates 282 and 283. The top portions of the left and right operation buttons 285 and 286 protrude out of the cleaning robot 500. Operation springs 287 are supported, at one portion, on either one of the left and right spray regulating plates 282 and 283, and, at the opposite portion, on the suction unit.

Here, the left and right spray regulating plates 282 and 283 are assembled to guides 213, which are horizontally formed in the housing 210, by being slidably inserted into the same.

In the spray regulator 280 as configured above, when the left or right operation button 285 or 286 is pushed (or vertically moved), the distal slope 284 on the bottom of the left or right operation button touches the left or right spray regulating plate 282 or 283, thereby horizontally sliding the same. When pushed again, the left or right operation button 285 or 286 returns to its original position due to the elasticity of the operation spring 287 connected to the left or right spray regulating plate 282 or 283.

Since the left and right operation buttons, acting in a one-touch fashion, are well known in the art, they will not be described further.

Due to the operation of the spray regulator 280, as mentioned above, the exit holes 270 of the spray nozzle unit can be opened or closed by the openable holes 281 of the left or right spray regulating plate 282 or 283.

Alternatively, as shown in FIG. 11, left and right spray regulating plates 282' and 283' can be integrally provided with left and right movable buttons 285' and 286', which slidably operate the left and right spray regulating plates 282' and 283', so that the opening of the exit holes of the spray nozzle unit can be controlled by the lateral movement of the left and right movable buttons 285' and 286'.

The openable holes 281, having the same size as the exit holes 270, are formed in the bottom of the left and right spray regulating plates 282 and 283, which are formed to be laterally slidable outside the housing 210. The distal ends of the left and right movable buttons 285' and 286' are integrally connected to the left and right spray regulating plates 282 and 283.

In the spray regulator as shown in FIG. 11, when the left or right movable button 285' or 286' is slid to the left or right, the left or right spray regulating plate 282' or 283', connected thereto, is slid to the left or right along with the guide of the housing, so that it regulates the opening of the exit holes by aligning the exit holes with the openable holes of the left or right spray regulating plate or adjusting the alignment of the exit holes and the openable holes.

As shown in FIG. 12, the body 310 of the suction unit is disposed on the underside of the cleaning robot body. An insert recess 320 for receiving the spray nozzle unit 200 is formed in the leading end of the suction unit body 310 and is placed in the front when seen from the moving direction of the cleaning robot. A suction hole 330 is formed in the center of the suction unit body to be positioned behind the insert recess 320, and an anti-dispersion belt 340 extends down from the rear portion of the suction unit body and is placed behind the suction hole 330.

The anti-dispersion belt 340 is arranged along the length of the suction unit body to have a curved shape (or an arc shape), that is, to be convex rearward with respect to the moving direction of the cleaning robot. The anti-dispersion belt 340 is connected, at the top end, to the suction unit body 310, and, at the bottom end, to the surface to be cleaned. The anti-dispersion belt 340 is made of an elastic material such as silicone or rubber, which can closely adhere to an object.

As shown in FIGS. 1 to 3, the anti-dispersion belt 340 protrudes a predetermined length beyond the opposing ends of the suction unit.

In addition, as shown in FIGS. 1 to 3, auxiliary rollers 350 are disposed on the opposing ends of the leading part of the suction unit body in order to allow the cleaning robot to run but prevent the suction unit from colliding with an obstacle.

The suction unit 300 is vertically adjusted by a vertical buffer member within an effective range according to the condition of the surface to be cleaned. Since a technical construction for vertical adjustment within a desired range is a well known technical construction that uses a spring, detailed description thereof will be omitted.

According to the present invention as set forth above, when the cleaning robot moves to clean the surface, the air and dust are drawn in through the suction unit and are blown through a suction passage 530 to the dust connecting unit 520, which captures the dust, so that the air from which the dust has been removed is fed through the exhaust air feedback unit to the spray nozzle unit, which then sprays the clean air onto the surface to be cleaned.

When the air is sprayed onto the surface to be cleaned, foreign materials are scattered from the surface and are then fed through the suction unit to the dust collector.

Here, the anti-dispersion belt cooperates with an air curtain formed by the circulating air sprayed through the spray nozzle unit in order to prevent the foreign materials from escaping from the cleaning robot and dispersing.

Figure 13:
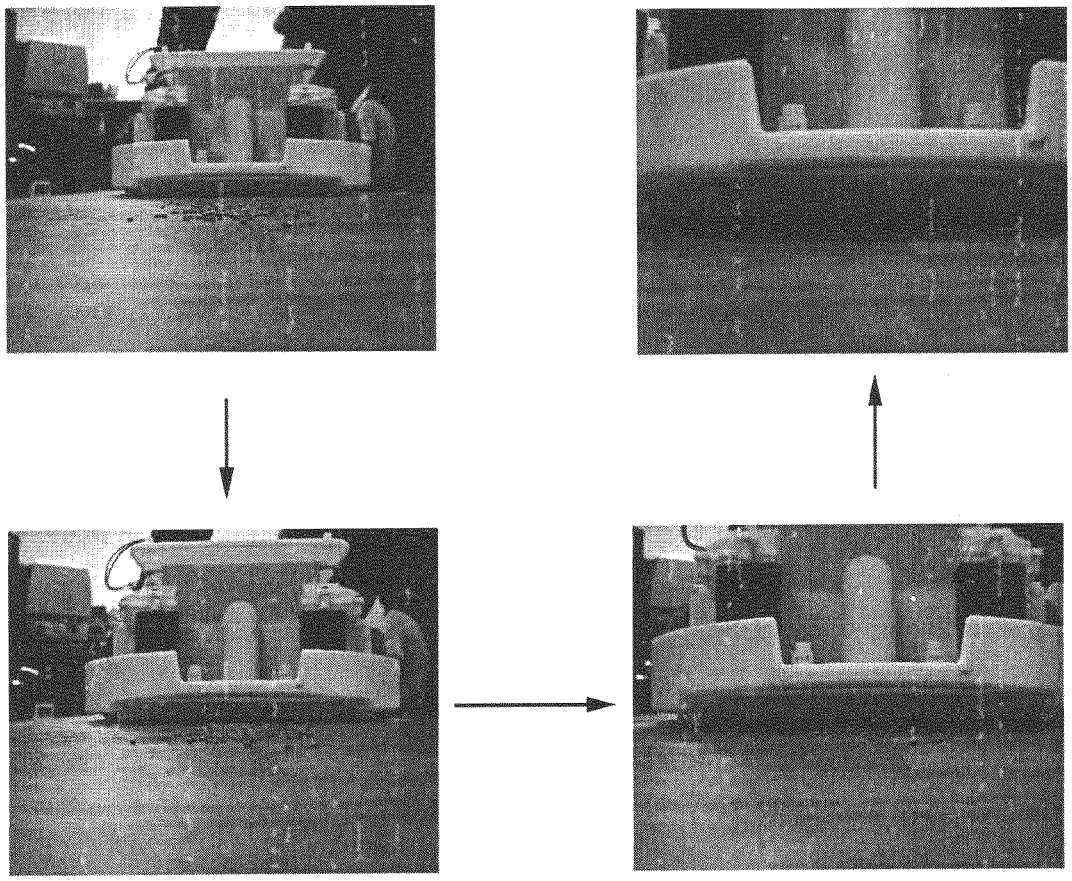
FIG. 13 illustrates the cleaning ability of the cleaning robot according to the present invention.
Figure 14:
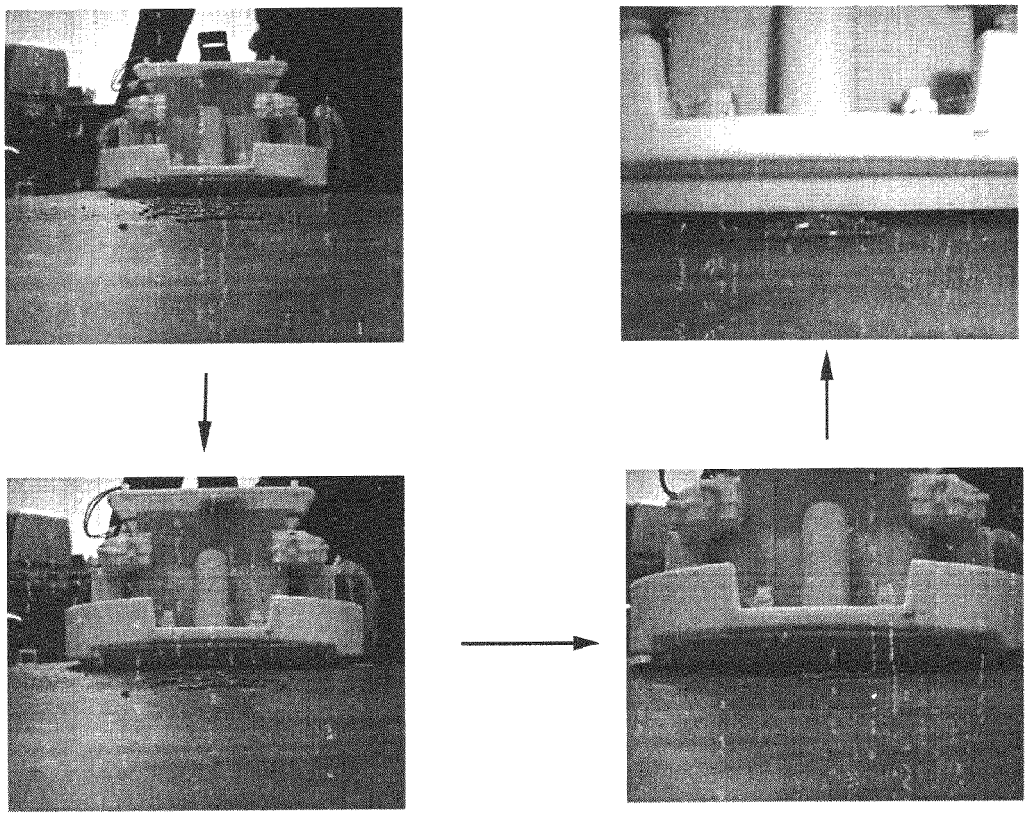
FIG. 14 illustrates the cleaning ability of a conventional suction type cleaning robot.

FIG. 13 illustrates the cleaning ability of the cleaning robot according to the present invention, and FIG. 14 illustrates the cleaning ability of a conventional suction type cleaning robot. Suction motors having the same capacity were used in the cleaning robot of the present invention and in the conventional cleaning robot. Upon comparison with the conventional cleaning robot, it can be understood that the cleaning robot of the present invention having an exhaust air feedback function can remove foreign materials much more satisfactorily.

In the present invention, side nozzle units can also be provided in connection with the exhaust air feedback unit. The side nozzle units are designed to exhaust the circulating air of the exhaust air feedback unit 100 from opposing sides of the suction unit 300 toward the suction hole 330. Each of the side nozzle units is connected, at one side end, to a respective one of the left and right air passages 110 and 120 of the exhaust air feedback unit, and at the opposite side, to the suction unit 300. With this configuration, the side nozzle units spray the circulating air toward the center, where the suction hole 330 is located, from both sides of the suction unit.

The side nozzle units will now be described more fully with reference to the drawings.

Figure 15:
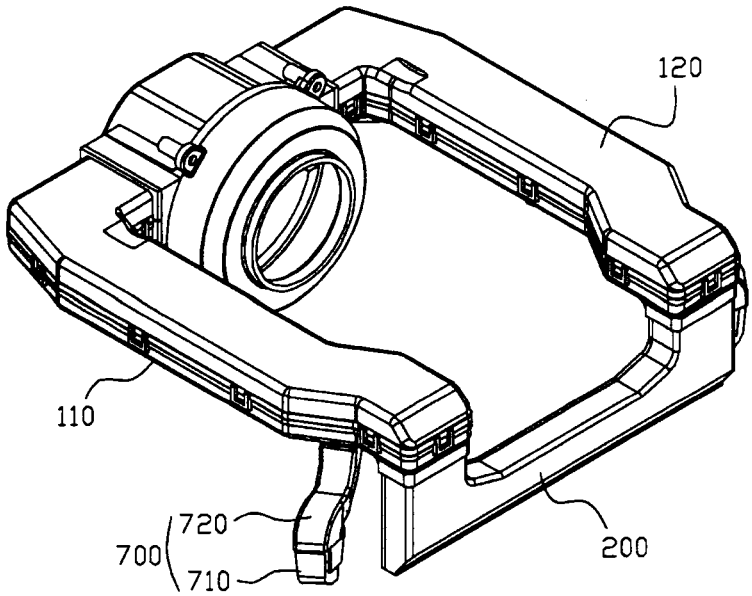
FIG. 15 illustrates the side nozzle units provided according to the present invention.
Figure 15:
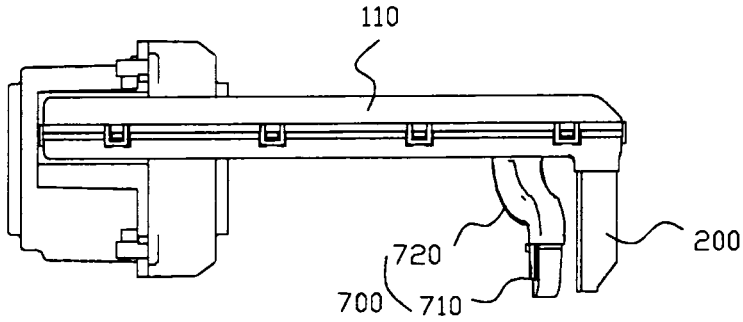
Figure 16:
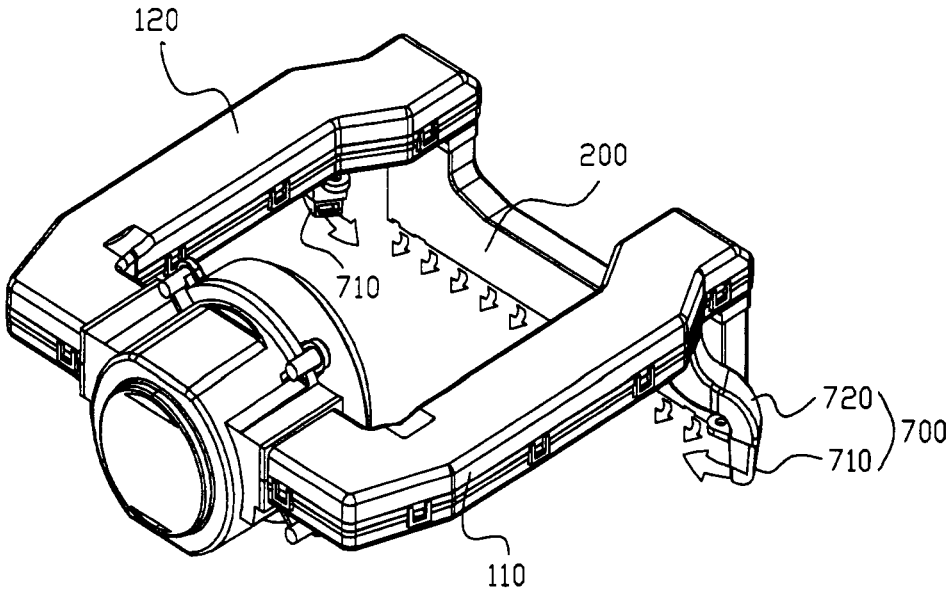
FIG. 16 illustrates the flow of the circulating air by the size nozzle units according to the present invention.
Figure 17:
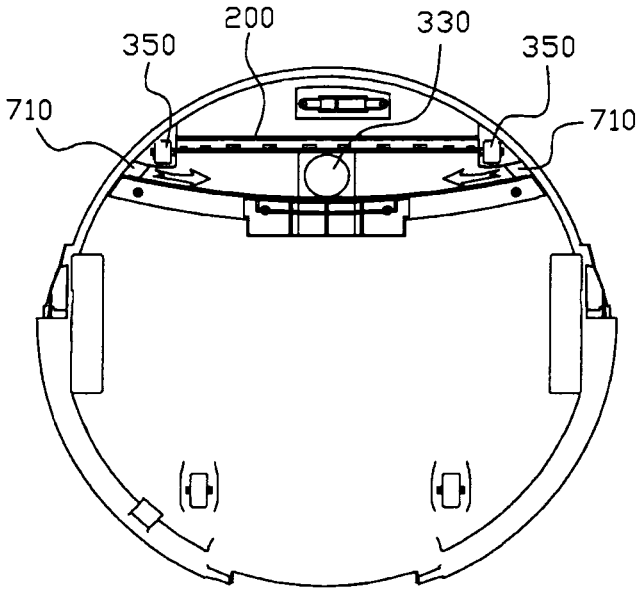
FIG. 17 is a bottom view of the present invention with the size nozzle units.
Figure 18:
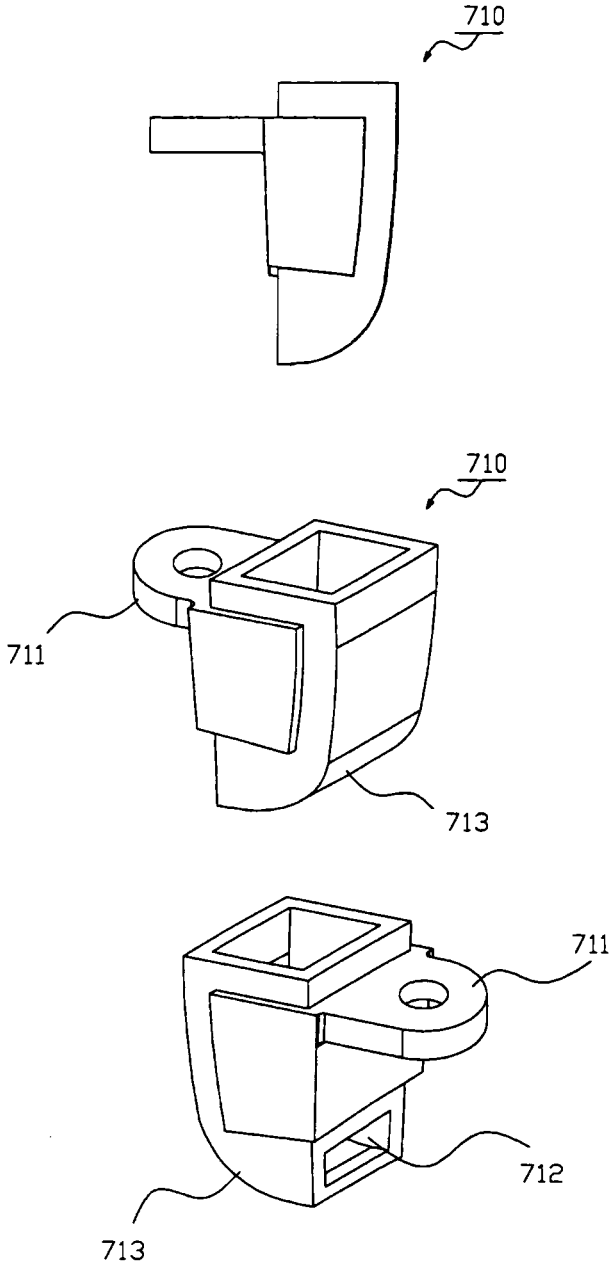
FIG. 18 illustrates the construction of the side nozzle according to the present invention.
Figure 19:
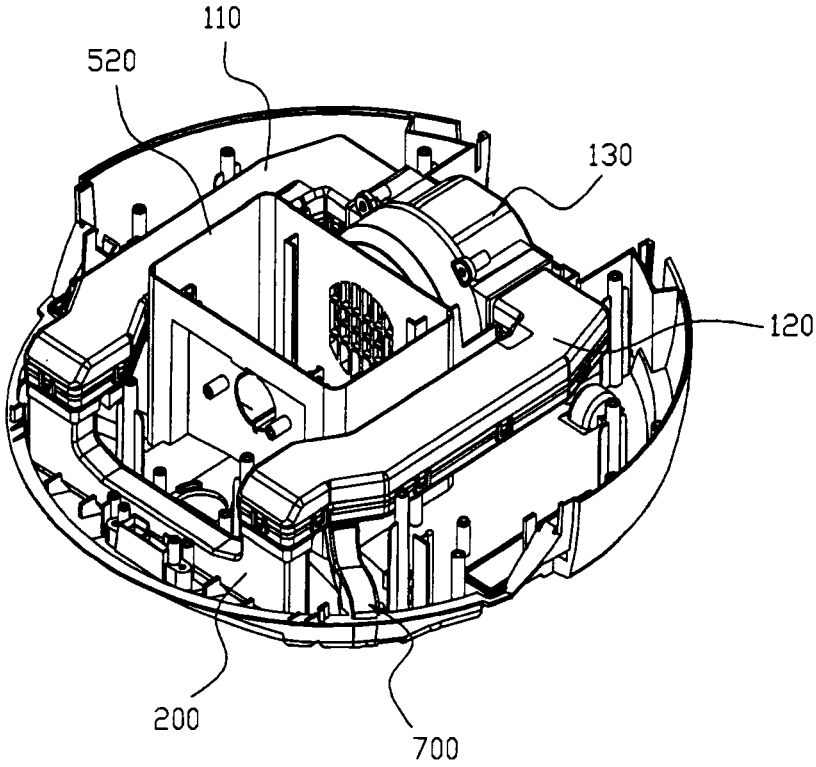
FIG. 19 illustrates the overall construction of the present invention with the side nozzles.

FIG. 15 illustrates the side nozzle units provided according to the present invention, FIG. 16 illustrates the flow of the circulating air by the size nozzle unit according to the present invention, FIG. 17 is a bottom view of the present invention with the size nozzle units, FIG. 18 illustrates the construction of the side nozzle according to the present invention, and FIG. 19 illustrates the overall construction of the present invention with the side nozzles. Each of the side nozzle units includes a side nozzle 710, which is placed on either side of the suction unit 300. The side nozzle 710 has a nozzle hole 712 in a lower portion thereof, which is directed toward the suction unit 330. The side nozzle unit also includes an auxiliary air passage 720, which is connected at one end to the side nozzle and at the opposite end to a respective one of the left and right air passage 110 and 120 of the exhaust air feedback unit 100.

As shown in FIG. 19, the top portion of the side nozzle 710 is inserted into and assembled to the auxiliary air passage 720. The side nozzle 710 has a coupling section 711, which protrudes from one portion thereof and is assembled to the suction unit 300 by a bolt, and a nozzle hole 712, which is formed in the bottom portion and faces sideways. In addition, the side nozzle 710 has a curved lower portion 713, so that the circulating air introduced from the top portion is naturally introduced into the nozzle hole 712 and is sprayed out from the nozzle hole 712.

The nozzle hole 712 is placed on either side of the suction unit 300 and is directed to the center of the suction unit, so that the side nozzle 710 is placed between the side nozzle 710 and the anti-dispersion belt 340 of the suction unit.

In the present invention having the side nozzle units 700 as configured above, as shown in FIGS. 16 and 17, the circulating air introduced through the left and right air passages 110 and 120 of the exhaust air feedback unit is sprayed through the spray nozzle unit 200 and the side nozzle units 700 to the surface to be cleaned and toward the suction hole 330 of the suction unit, so that foreign materials are moved from the surface to be cleaned toward the suction hole 330.

While the present invention has been described with reference to the particular illustrative embodiments and the accompanying drawings, it is not to be limited thereto, but will be defined by the appended claims. It is to be appreciated that those skilled in the art can substitute, change or modify the embodiments in various forms without departing from the scope and spirit of the present invention.

The invention claimed is:

1. A cleaning robot, comprising:

a suction unit disposed in a lower portion of the cleaning robot;

a suction motor for drawing in foreign materials from a surface to be cleaned, along with air, through the suction unit;

a suction motor supporter supporting the suction motor, outlets being formed in both sides of a lower portion of the suction motor supporter;

a dust collector capturing the foreign materials that are drawn in through the suction motor;

an exhaust air feedback unit feeding a circulating air that is exhausted through the suction motor, the exhaust air feedback unit including a rotatable grill connected to the dust collector, placed inside the cleaning robot, and enclosing the suction motor, wherein the suction motor supporter is disposed in the rotatable grill, and left and right air passages, each having one end connected to the rotatable grill and an opposite end; and a spray nozzle unit placed on a leading end of the suction unit, the spray nozzle being connected to the opposite end of the left and right air passages, the spray nozzle unit spraying the circulating air fed by the exhaust air feedback unit onto the surface to be cleaned.

2. The cleaning robot according to claim 1, further comprising connecting passages disposed between the exhaust air feedback unit and the spray nozzle unit.

3. The cleaning robot according to claim 1, wherein each of the left and right air passages has a vent hole and a knob to open or close the vent hole.

4. The cleaning robot according to claim 2, wherein the spray nozzle unit includes:

a housing having a slope on a lower surface portion thereof;

connecting sections arranged on either side of an upper part of the housing, each of the connecting sections connected to a corresponding one of the connecting passages;

a plurality of air guides dividing an interior of the housing into a plurality of spaces and extending from the connecting sections to a lower portion of the housing; and a plurality of air spray passages defined by the air guides.

5. The cleaning robot according to claim 4, wherein the spray nozzle unit further includes partitions disposed on lower ends of the air guides and placed inside the housing of the spray nozzle, the partitions defining buffer areas, each of the buffer areas being arranged between adjacent air spray passages.

6. The cleaning robot according to claim 5, wherein the spray nozzle unit further includes a spray regulator adjusting a size of exit holes arranged in lower ends of the air spray passages.

7. The cleaning robot according to claim 6, wherein the spray regulator is laterally slidable.

8. The cleaning robot according to claim 6 or 7, wherein the spray regulator includes:

left and right spray regulating plates disposed outside the housing in a laterally slidable fashion, each of the left and right spray regulating plates having openable holes in a bottom surface thereof, the openable holes having a size equal with that of the exit holes;

left and right operation buttons, each of which has a distal slope in contact with either one of the left and right spray regulating plates and a top portion protruding out of the cleaning robot; and operation springs, each of which has one portion supported on either one of the left and right spray regulating plates and an opposite portion supported on the suction unit.

9. The cleaning robot according to claim 6 or 7, wherein the spray regulator includes:

left and right spray regulating plates disposed outside the housing in a laterally slidable fashion, each of the left and right spray regulating plates having openable holes in a bottom surface thereof, the openable holes having a size equal with that of the exit holes; and left and right movable buttons, each of which has a bottom portion integrally connected to an end of a corresponding one of the left and right spray regulating plates and a top portion protruding out of the cleaning robot.

10. The cleaning robot according to claim 1, wherein the suction unit includes:

a suction unit body disposed on an underside of a body of the cleaning robot;

an insert recess for receiving the spray nozzle unit, the insert recess formed in a leading end of the suction unit body;

a suction hole formed in a central portion of the suction unit body; and an anti-dispersion belt placed behind the suction hole and extending down from a rear portion of the suction unit body.

11. The cleaning robot according to claim 1 or 10, wherein the suction unit includes side nozzle units disposed on both sides thereof, wherein the side nozzle units are connected to the exhaust air feedback unit to exhaust the circulating air toward the suction hole.

12. The cleaning robot according to claim 11, wherein each of the side nozzle units includes:

a side nozzle placed on either side of the suction unit and having a nozzle hole in a lower portion thereof, the nozzle hole directed toward the suction unit; and an auxiliary air passage connected at one end to the side nozzle and at an opposite end to a corresponding one of the left and right air passages of the exhaust air feedback unit.

* * * * *